US008925715B2

(12) United States Patent
Karasawa et al.

(10) Patent No.: US 8,925,715 B2
(45) Date of Patent: Jan. 6, 2015

(54) FEEDING APPARATUS FOR METAL STRIPS

(75) Inventors: Masanao Karasawa, Tokyo (JP); Toshiyuki Nanaarashi, Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 227 days.

(21) Appl. No.: 13/461,169

(22) Filed: May 1, 2012

(65) Prior Publication Data

US 2013/0134203 A1 May 30, 2013

(30) Foreign Application Priority Data

Nov. 28, 2011 (JP) ..... 2011-259125

(51) Int. Cl.
*B65G 47/244* (2006.01)
*B65H 20/00* (2006.01)

(52) U.S. Cl.
USPC ..... 198/725; 226/170; 226/74

(58) Field of Classification Search
None
See application file for complete search history.

(56) References Cited

U.S. PATENT DOCUMENTS 5,349,841 A * 9/1994 Honma et al. ..... 72/333

FOREIGN PATENT DOCUMENTS

| | | | |
|---|---|---|---|
| JP | 62-173953 | A | 7/1987 |
| JP | 04-064561 | A | 2/1992 |
| JP | 6-211394 | A | 8/1994 |
| JP | 07-091873 | A | 4/1995 |

* cited by examiner

*Primary Examiner* — Kavel Singh
(74) *Attorney, Agent, or Firm* — Birch, Stewart, Kolasch & Birch, LLP

(57) ABSTRACT

A feeding apparatus feeds a metal strip with cutaway portions in a conveying direction and includes: a reference plate on which the metal strip is placed and in which a slit is formed; moving bodies that are provided below the reference plate and are moved by driving means parallel to the reference plate in the conveying direction; feed pins that advance into the cutaway portions, are provided on the moving bodies so as to move up and down with respect to the reference plate, and pull the metal strip in the conveying direction when the moving bodies move; and at least one guide portion that contacts a side surface on an opposite side of the metal strip to the cutaway portions and guides conveyance of the metal strip.

4 Claims, 9 Drawing Sheets

FEEDING APPARATUS FOR METAL STRIPS

CROSS-REFERENCE TO RELATED APPLICATION(S)

This application is based upon and claims the benefit of priority of the prior Japanese Patent Application No. 2011-259125, filed on Nov. 28, 2011, the entire contents of which are incorporated herein by reference.

FIELD

The present invention relates to a feeding apparatus for metal strips used at a stage before heat exchanger fins that use flattened tubes are cut into predetermined lengths.

BACKGROUND

An existing heat exchanger, such as an air conditioner, is typically constructed by stacking a plurality of heat exchanger fins, in which a plurality of through-holes have been formed to enable heat exchanger tubes to be inserted.

Such heat exchanger fins are manufactured by a manufacturing apparatus for heat exchanger fins depicted in FIG. 16. The manufacturing apparatus for heat exchanger fins is equipped with an uncoiler 12 where a thin metal plate 10 made of aluminum or the like has been wound into a coil. The thin plate 10 pulled out from the uncoiler 12 via pinch rollers is inserted into an oil applying apparatus 16 where machining oil is applied onto the surface of the thin plate 10, and is then supplied to a mold apparatus 20 provided inside a press apparatus 18.

The mold apparatus 20 internally includes an upper mold die set 22 that is capable of up-down movement and a lower mold die set 24 that is static. A plurality of collar-equipped through-holes (not illustrated), where collars of a predetermined height are formed around through-holes, are formed at predetermined intervals in a predetermined direction by the mold apparatus 20.

The result of machining the metal thin plate to produce the through-holes and the like is hereinafter referred to as the "metal strip 11". After being conveyed a predetermined distance in the predetermined direction, the metal strip 11 is cut into predetermined lengths by a cutter 26. The products (heat exchanger fins) produced by such cutting into predetermined lengths are stored in a stacker 28. The stacker 28 has a plurality of pins 27 erected in the perpendicular direction and stacks the manufactured heat exchanger fins by inserting the pins 27 into the through holes.

In this conventional manufacturing apparatus for heat exchanger fins, the press apparatus 18 is provided with a feeding apparatus that intermittently conveys the metal strip 11, in which a plurality of through-holes have been formed at predetermined intervals in a predetermined direction, toward the cutter 26.

FIG. 17 is a diagram useful in explaining the conveyance of the metal strip 11 by the operation of the feeding apparatus. The feeding apparatus inserts feed pins 32 from below into the through-holes formed in the metal strip 11 and, by moving the feed pins 32 in the conveying direction, conveys the metal strip 11 in the conveying direction.

The feed pins 32 are provided on moving bodies 30 that are capable of moving in the conveying direction. Through-holes that house the feed pins 32 are formed in the moving bodies 30, and the feed pins 32 are disposed so as to be capable of up-down movement inside the through-holes. In each through-hole, an enlarged diameter portion 29 formed with a large diameter is provided in a central position in the up-down direction.

A flange portion 33 with substantially the same diameter as the enlarged diameter portion 29 is formed on an intermediate part of each feed pin 32 disposed inside an enlarged diameter portion 29.

A spring 17 that is an energizing means is disposed between the flange portion 33 and the upper surface of the enlarged diameter portion 29. Via the flange portion 33, this spring 17 energizes the feed pin 32 so as to be normally pressed downward. Also, a lower end portion of each feed pin 32 protrudes from the through-hole beyond the lower surface of the moving body 30. A plate cam 74 is disposed so as to contact the protruding lower end portions of the feed pins 32.

When the lower end portion of a feed pin 32 contacts the plate cam 74, the feed pin 32 compresses the spring 17 and the upper end portion of the feed pin 32 rises while resisting the energizing force of the spring 17 to become inserted into a through-hole of the metal strip 11.

When the moving bodies 30 are moved in the conveying direction A in this state, the feed pins 32 pull the metal strip 11 so as to convey the metal strip 11. When a moving body 30 reaches a position where the plate cam 74 is not present, the feed pin 32 protrudes downward due to the energizing force of the spring 17 and the upper end portion of the feed pin 32 becomes withdrawn from a through-hole in the metal strip 11.

Patent Document 1

Japanese Laid-Open Patent Publication No. H06-211394

SUMMARY

On an existing heat exchanger fin, a plurality of through-holes into which heat exchanger tubes are inserted are formed in a metal strip.

However, at present, heat exchangers that use multi-channel flattened tubes are being developed. A heat exchanger fin that uses such flattened tubes is depicted in FIGS. 18A and 18B (and will sometimes be referred to hereinafter as a "flattened tube fin").

On a flattened tube fin 31, cutaway portions 34 into which the flattened tubes 5 are inserted are formed at a plurality of positions, and plate-like portions 36, where louvers 35 are formed, are formed between cutaway portion 34 and cutaway portion 34.

The cutaway portions 34 are formed from only one side in the width direction of the fin 31. Accordingly, the plate-like portions 36 between cutaway portion 34 and cutaway portion 34 are joined by a joining portion 38 that extends along the length direction.

However, if the metal strip in a state before molding into flattened tube fins (a state where the cutaway portions 34 have been formed but the metal strip has not been cut into predetermined lengths, hereinafter simply referred to as the "metal strip") is conveyed by a conventional feeding apparatus of a heat exchanger fin manufacturing apparatus, the following problem will occur. That is, with the flattened tube fin described above, since one side of the fin is open due to the provision of the cutaway portions 34, if the metal strip is conveyed by the feed pins 32 being inserted into the cutaway portions 34, there is the problem of the conveyance of the metal strip becoming skewed, resulting in extremely poor conveying precision.

The present invention was conceived to solve the problem described above and aims to provide a feeding apparatus that reliably conveys a metal strip for a flattened tube fin.

According to an aspect of the present invention, there is provided a feeding apparatus operable when manufacturing a flattened tube fin where cutaway portions, into which flattened tubes used for heat exchanging are inserted, are formed from one side toward another side in a width direction thereof, to feed a metal strip after formation of the cutaway portions in a thin metal plate but before cutting into predetermined lengths, the feeding apparatus including: a reference plate on whose upper surface the metal strip is placed and in which a slit, which extends in a conveying direction of the metal strip, is formed from an upper surface to a lower surface thereof; moving bodies that are provided below the reference plate and are capable of being moved by driving means parallel to the reference plate and in the conveying direction of the metal strip; feed pins that are capable of advancing into the cutaway portions of the metal strip, are provided on the moving bodies so as to be capable of moving up and down with respect to the reference plate, and pull the metal strip in the conveying direction in keeping with movement of the moving bodies when the feed pins have advanced into the cutaway portions of the metal strip; and at least one guide portion that contacts a side surface on an opposite side of the metal strip to the openings of the cutaway portions and guides conveyance of the metal strip.

By using this construction, it is possible to guide a metal strip during conveyance using a guide portion that contacts a side surface on the opposite side to the openings of the cutaway portions, which makes it possible to prevent skewing of the metal strip during conveyance and to reliably convey the metal strip.

The at least one guide portion may be provided so as to be capable of moving in the conveying direction together with the moving bodies.

That is, when the guide portion is fixed and does not move, there will be large resistance between the metal strip and the guide portion, resulting in the problem of possible deformation in the metal strip. However, by moving the guide portion together with the moving body in the conveying direction, it is possible to prevent deformation of the metal strip due to resistance between the side surface of the metal strip and the guide portion.

The front end portions of the feed pins may be formed so as to be split into pulling portions, which advance into the cutaway portions and pull the metal strip, and the at least one guide portion.

By using this construction, since it is possible to use one feed pin as both the guide portion and the pulling portion that does the actual pulling, it is possible to prevent deformation of the metal strip due to resistance between the side surface of the metal strip and the guide portion, without increasing the number of component parts.

According to the present invention, it is possible to reliably convey a metal strip for a flattened tube fin.

DESCRIPTION OF EMBODIMENT(S)

Figure 1:
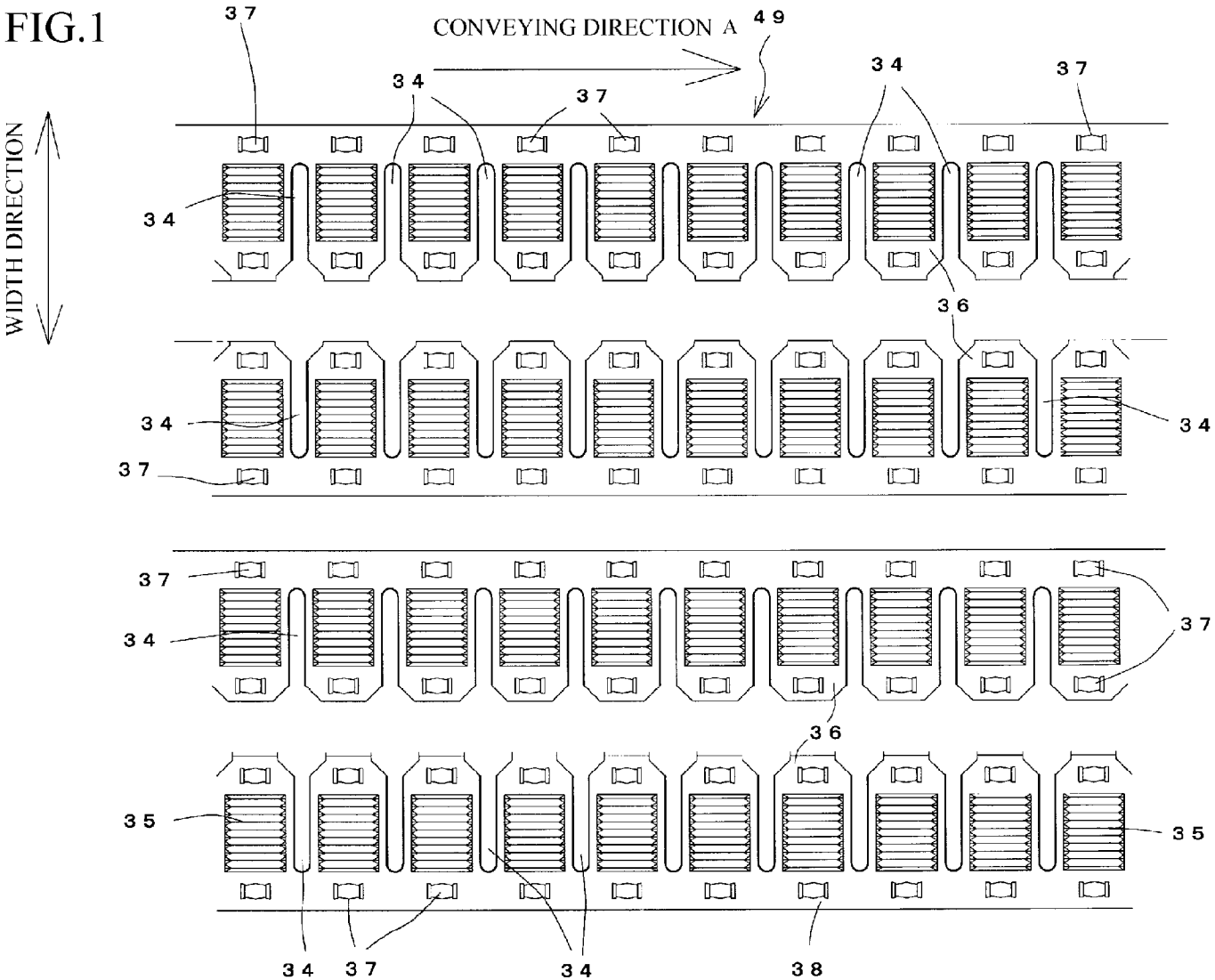
FIG. 1 is a plan view of a metal strip used for a flattened tube fin.

First, a metal strip in a state after the formation of cutaway portions in a thin metal plate but before cutting into predetermined lengths during a manufacturing process that manufactures flattened tube fins is depicted in FIG. 1.

Figures 18A, 18B:
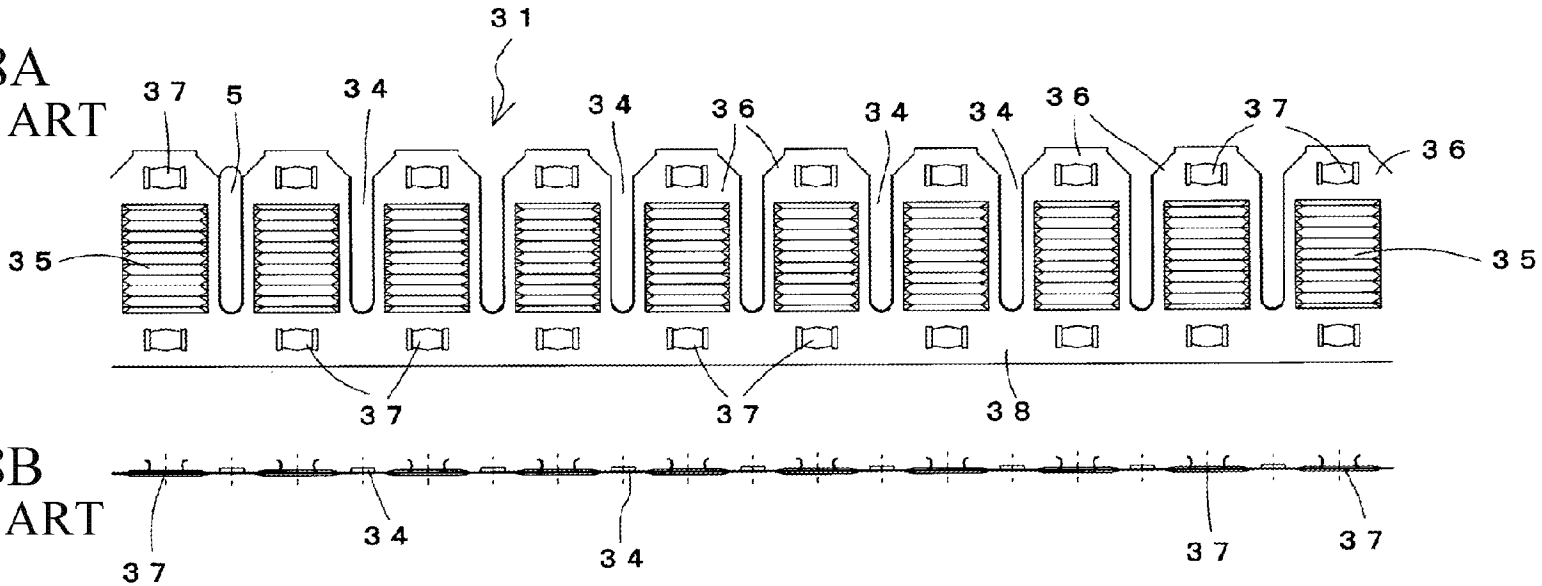
FIG.18A PRIOR ART
FIG.18B PRIOR ART
FIG. 18A is a plan view of a flattened tube fin and FIG. 18B is a side view of a flattened tube fin.

Note that since the flattened tube fins produced by cutting the thin metal plate into predetermined lengths have been described above with reference to FIG. 18, the description here will instead focus on the construction of a metal strip 49.

The metal strips 49 depicted in FIG. 1 have four products formed in a line in the width direction that is perpendicular to the conveying direction A.

The respective metal strips 49 each have cutaway portions 34 into which flattened tubes 5 will be inserted formed at a plurality of positions and plate-like portions 36, where louvers 35 are formed, formed between cutaway portion 34 and cutaway portion 34. Openings 37 formed by cutting and folding up the thin metal plate are formed at both end portions in the width direction of the louvers 35. Out of the two openings 37, 37 formed for one louver 35, one opening 37 is formed at a front end portion side of the plate-like portion 36.

The cutaway portions 34 are formed from only one side in the width direction of each metal strip 49. Accordingly, the plurality of plate-like portions 36 between cutaway portion 34 and cutaway portion 34 are joined by a joining portion 38 that extends in the length direction.

Out of the two openings 37, 37 for one louver 35 described above, the opening 37 on the other side is formed on the joining portion 38.

With the metal strips 49 depicted in FIG. 1, two products disposed with the open ends of the cutaway portions 34 adjacent to one another form a pair, and two of such pairs are formed. That is, the pairs, in which the open ends of the cutaway portions 34 of two products are disposed facing one another, are placed so that the joining portions 38 thereof are adjacent.

In this way, by disposing four products in an alternating arrangement, the left-right load balance of the mold is improved.

Figure 2:
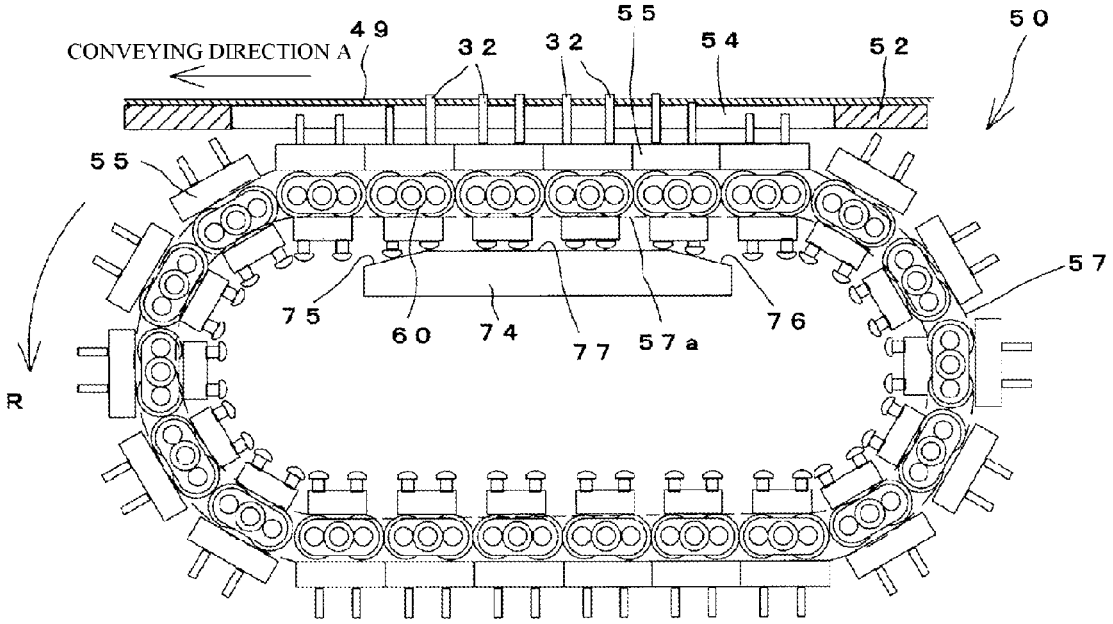
FIG. 2 is a side view depicting the overall construction of a feeding apparatus according to the present invention.
Figure 3:
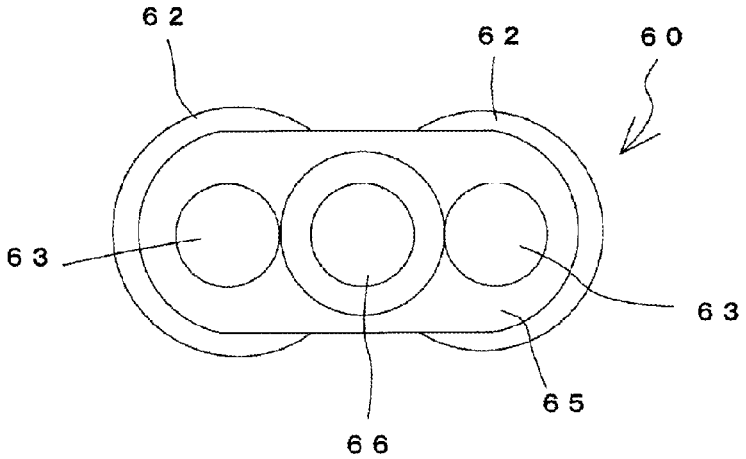
FIG. 3 is a side view of a guide portion of the feeding apparatus.
Figure 4:
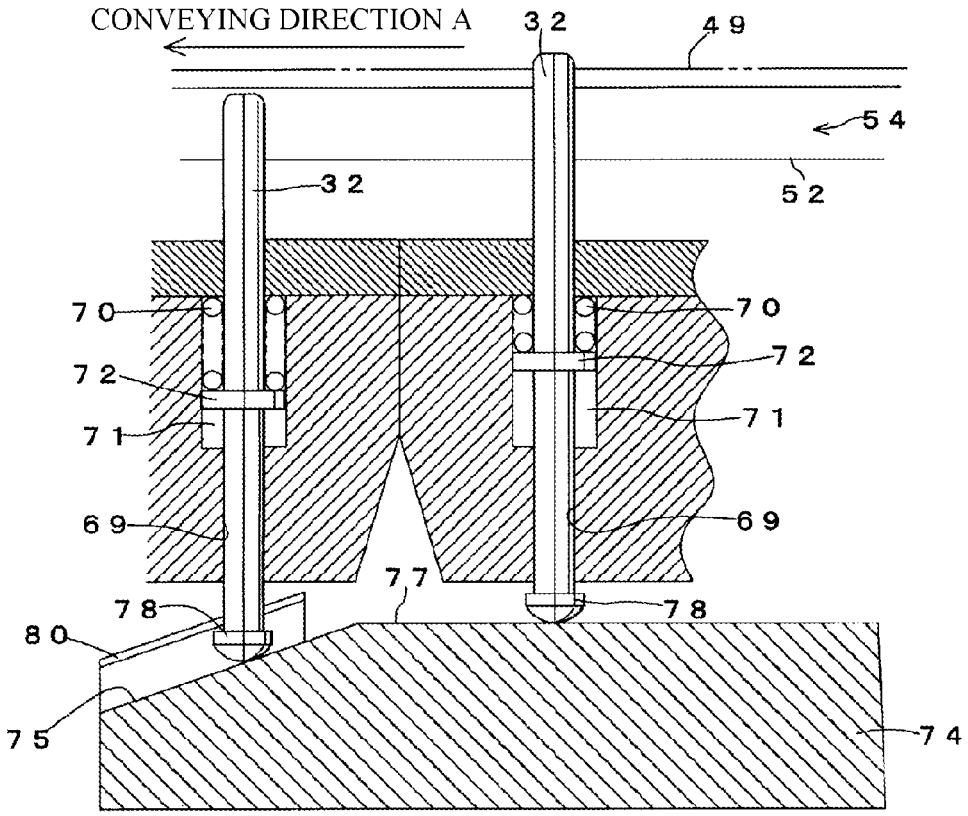
FIG. 4 is a cross-sectional view of a feed portion of the feeding apparatus.

Next, the construction of a feeding apparatus will be described. FIG. 2 depicts the overall construction of a feeding apparatus, FIG. 3 depicts the construction of a guide portion, and FIG. 4 depicts the construction of a moving body.

The feeding apparatus 50 includes: a reference plate 52 in which at least one slit 54 that extends in the conveying direction A of the metal strip 49 is formed; moving bodies 55 that are provided below the reference plate 52 and are capable of moving in the conveying direction A of the metal strip 49; feed pins 32 which are provided on the respective moving bodies 55 so as to be capable of advancing into the cutaway portions 34 of a metal strip 49 and of moving up and down relative to the reference plate 52 and after advancing into the cutaway portions 34 of the metal strip 49 pull the metal strip 49 in the conveying direction A in keeping with movement of the moving bodies 55; and at least one guide portion 82 (see FIG. 5 onwards) which contacts a side surface on the opposite side of the metal strip to the side in which the cutaway portions 34 are open and which guides the conveyance of the metal strip.

The metal strip 49, in which a plurality of the cutaway portions 34 have been formed in a row in the conveying direction A, is placed on the reference plate 52. The slits 54 formed in the reference plate 52 extend in the feeding direction of the metal strip 49.

Below the reference plate 52, guide plates (not illustrated) are provided on both sides in the width direction of the reference plate 52, with channels 57 (illustrated using broken lines in FIG. 2) in the form of endless track being formed in each guide plate. Each channel 57 is formed so that the moving bodies 55 can circulate on a perpendicular plane and when seen from the side is in the form of a flattened oval that is elongated in the conveying direction and where the horizontal direction (conveying direction) is linear, so that the parts where the moving bodies 55 move parallel to the conveying direction of the metal strip 49 are elongated.

Guide portions 60 that fit into the grooves 57 are formed on each moving body 55 so that the moving bodies 55 are capable of moving along the grooves 57.

As depicted in FIG. 3, each guide portion 60 has guide rollers 62 that are capable of rotation about rotational shafts 63 that extend in the width direction provided at two positions at the front and back in the conveying direction A. The guide rollers 62 contact inner wall surfaces of the grooves 57 and guide movement of the moving bodies 55 along the grooves 57.

The two guide rollers 62 are connected by a link bracket 65, and a roller 66 that contacts the front end portion of a driving wheel (not illustrated) and transmits the motive force of the driving wheel is provided on the link bracket 65.

A plurality of the moving bodies 55 are disposed inside the grooves 57. The respective moving bodies 55 are provided so as to be capable of successively moving in the direction of the arrow R due to the driving wheel (not illustrated) which is driven by a servo motor or the like.

Due to the moving bodies 55 moving along the grooves 57, the feed pins 32 provided on the moving bodies 55 positioned in a parallel part 57 at the top successively advance into the cutaway portions 34 of the metal strip 49 and pull the metal strip 49 in the conveying direction.

As depicted in FIG. 4, through-holes 69 that pass through the moving bodies 55 in the up-down direction and slidably house the feed pins 32 are formed in the moving bodies 55, with the feed pins 32 being attached in the vertical direction inside the through-holes 69. A plurality of feed pins 32 may be disposed in a width direction on one moving body 55.

Also, lower end portions of the respective feed pins 32 protrude beyond the lower surfaces of the moving bodies 55

An enlarged diameter portion 71 where the diameter is larger than the feed pin 32 is formed at an intermediate part of each through-hole 69 in the moving bodies 55 and a spring 70 that is an energizing means that energizes a feed pin 32 downward is disposed in such enlarged diameter portion 71. A flange portion 72 formed with substantially the same diameter as the enlarged diameter portion 71 is provided on a part of each feed pin 32 that positionally corresponds to the enlarged diameter portion 71. The spring 70 with the downward energizing force is disposed between the upper surface of the flange portion 72 and the top surface of the enlarged diameter portion 71.

A plate cam 74, whose vertical cross-sectional form is substantially trapezoidal and that has inclined surfaces 75, 76 formed on both end portions along the conveying direction A, is provided below the moving bodies 55 at a position where the reference plate 52 is provided.

The inclined surface 76 that is positioned upstream in the conveying direction is formed so that the height gradually increases when moving in the conveying direction A and the inclined surface 75 that is positioned downstream in the conveying direction is formed so that the height gradually decreases when moving in the conveying direction A.

A horizontal surface 77 is formed between the inclined surfaces 75, 76 of the plate cam 74. The horizontal surface 77 is positioned in the height direction so as to be capable of contacting the lower end portions of the feed pins 32 and pressing the feed pins 32 upward against the energizing force of the spring 70.

That is, when a moving body 55 is not positioned on the plate cam 74, the lower end portion of the feed pin 32 protrudes downward due to the spring 70, but on approaching the plate cam 74, the lower end portion of the feed pin 32 contacts the inclined surface 76 of the plate cam 74 so that the lower end portion of the feed pin 32 that protrudes beyond the lower surface of the moving body 55 is gradually pushed upward by the inclined surface 76. After this, when the lower end portion of a feed pin 32 reaches the horizontal surface 77, the feed pin 32 is pressed completely upward so that the front end portion of the feed pin 32 fits into a cutaway portion 34 of the metal strip 49 positioned above the slit 54 in the reference plate 52.

A moving body 55 that has moved the metal strip 49 by a predetermined distance by way of the feed pin 32 becomes gradually separated from the position where the plate cam 74 is provided. At this time, the lower end portion of the feed pin 32 contacts the inclined surface 75 that becomes gradually lower, and gradually protrudes downward due to the energizing force of the spring 70, resulting in the front end portion of the feed pin 32 gradually becoming withdrawn from the cutaway portion 34 of the metal strip 49.

Note that in the present embodiment, a flange portion 78 is formed at the lower end portion of each rod-shaped feed pin 32. A contact plate 80 that contacts the flange portion 78 and forcibly presses the flange portion 78 in a downward direction for the feed pin 32 is formed in parallel along the inclined surface 75 formed on the downstream side of the plate cam 74 in the feeding direction of the metal strip 49. By using this construction, it is possible to forcibly withdraw the feed pins 32 downward even when a feed pin 32 that does not protrude downward due to the energizing force of the spring 70 alone is present.

First Embodiment of Guide Portions

Figure 5:
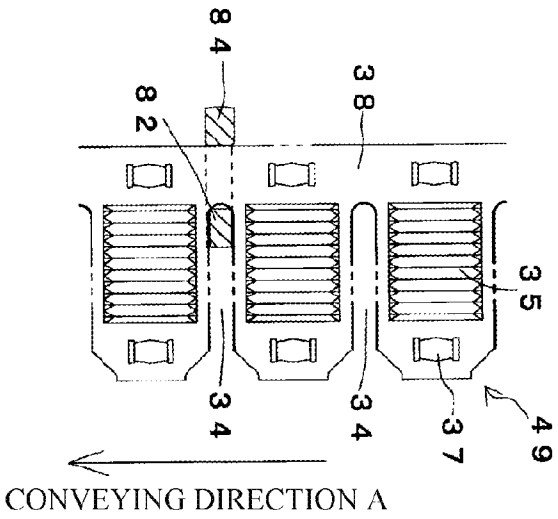
FIG. 5 is a plan view depicting how a metal strip is fed in a conveying direction using feed pins that have feed portions and guide portions formed at the front ends thereof.
Figure 6:
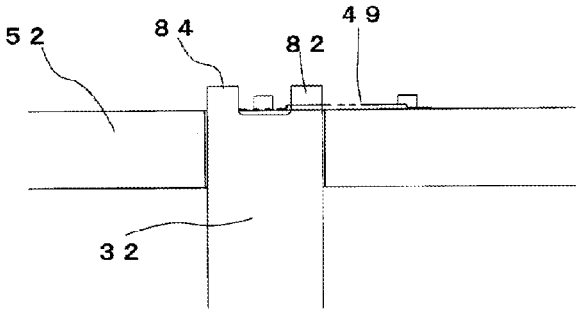
FIG. 6 is a front view depicting the state in FIG. 5 when looking from the front in the feeding direction.

FIG. 5 is a plan view useful in explaining a feed pin and a guide portion and FIG. 6 is a front view when looking from the front in the conveying direction.

According to the present invention, in order to convey the metal strip 49 used for flattened tube fins, a guide portion 84 that contacts a side surface on the opposite side to the openings of the cutaway portions 34 in the metal strip 49 and guides the conveyance of the metal strip 49 is provided.

In the embodiment depicted in FIGS. 5 and 6, the front end portion of each feed pin 32 is constructed so as to be split into two prongs, namely the guide portion 84 and the feed portion 82. The guide portion 84 and the feed portion 82 are provided in a line along the width direction that is perpendicular to the conveying direction. Note that with this construction, since it is only possible to see that the front end portions of the feed pins 32 are split into two prongs when the feed pins 32 are seen from the front in the conveying direction, the guide portions 84 are not visible in FIGS. 2 and 4 that are side views.

In this embodiment, when a feed pin 32 rises, the feed portion 82 advances into a cutaway portion 34 of the metal strip 49 and the guide portion 84 contacts the side surface on the opposite side to the opening of the cutaway portion 34. That is, the joining portion 38 of the metal strip 49 becomes held in the width direction by the guide portion 84 and the feed portion 82.

By moving the moving bodies 55, the feed pins 32 are moved together with the moving bodies 55 in the conveying direction. This means that it is possible for the feed portion 82 to pull and convey the metal strip 49 in the conveying direction and while doing so for the guide portion 84 to constantly support the side surface of the metal strip 49. In this way, it is possible to prevent skewing of the metal strip 49 during conveyance and to convey the metal strip 49 precisely.

Figure 7:
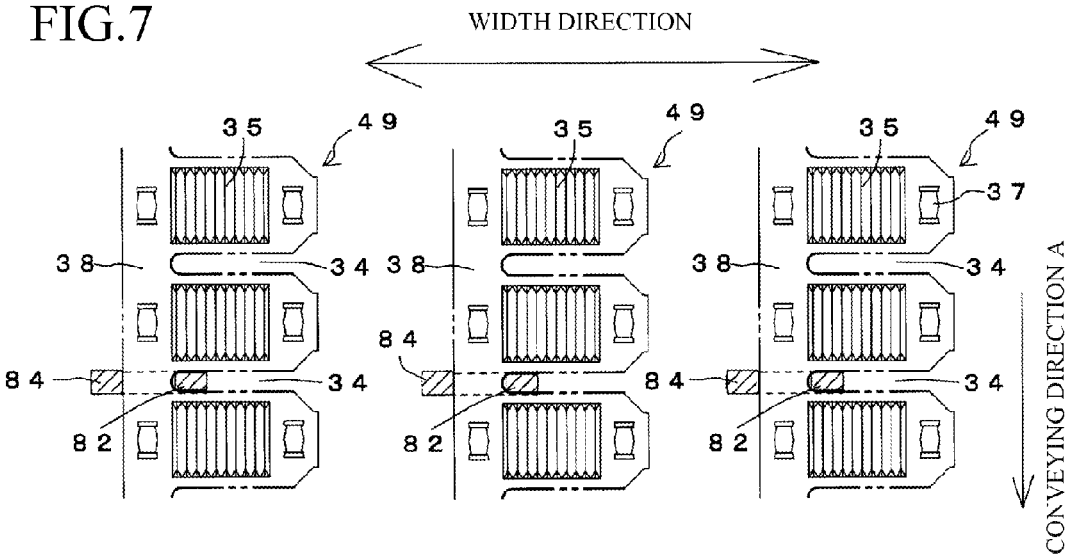
FIG. 7 is a plan view depicting how metal strips are fed in the conveying direction using feed pins that have feed portions and guide portions formed at front ends thereof for a multiple tool setting where the metal strips face in the same direction.
Figure 8:
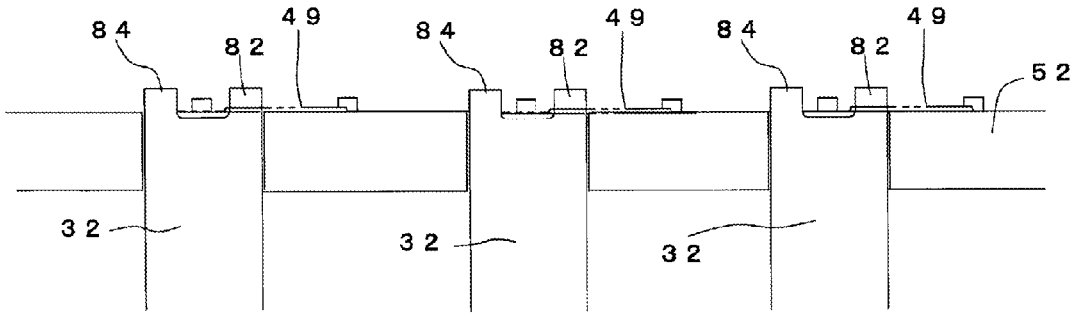
FIG. 8 is a front view depicting the state in FIG. 7 when looking from the front in the feeding direction.

FIGS. 7 and 8 depict an example of a "multiple tool setting" where the front end portions of the feed pins 32 are split into two prongs, namely the guide portion 84 and the feed portion 82 and where a plurality of metal strips 49 are disposed in the width direction and are simultaneously conveyed.

In the multiple tool setting depicted in FIG. 7, the plurality of metal strips 49 are in an aligned arrangement where the openings of the cutaway portions 34 all face in the same direction. In this case, by disposing the feed pins 32 whose front end portions are split into two prongs to form the guide portion 84 and the feed portion 82 so as to correspond to the respective metal strips 49, it is possible to convey the respective metal strips 49 in the conveying direction.

As depicted in FIG. 8, the plurality of feed pins 32 are disposed along the width direction with respect to one moving body 55 that extends in the width direction. By providing a feed pin 32 corresponding to each metal strip 49 on each of the moving bodies 55, it is possible to synchronize the up-down movement and conveying speed of the respective feed pins 32.

Figure 9:
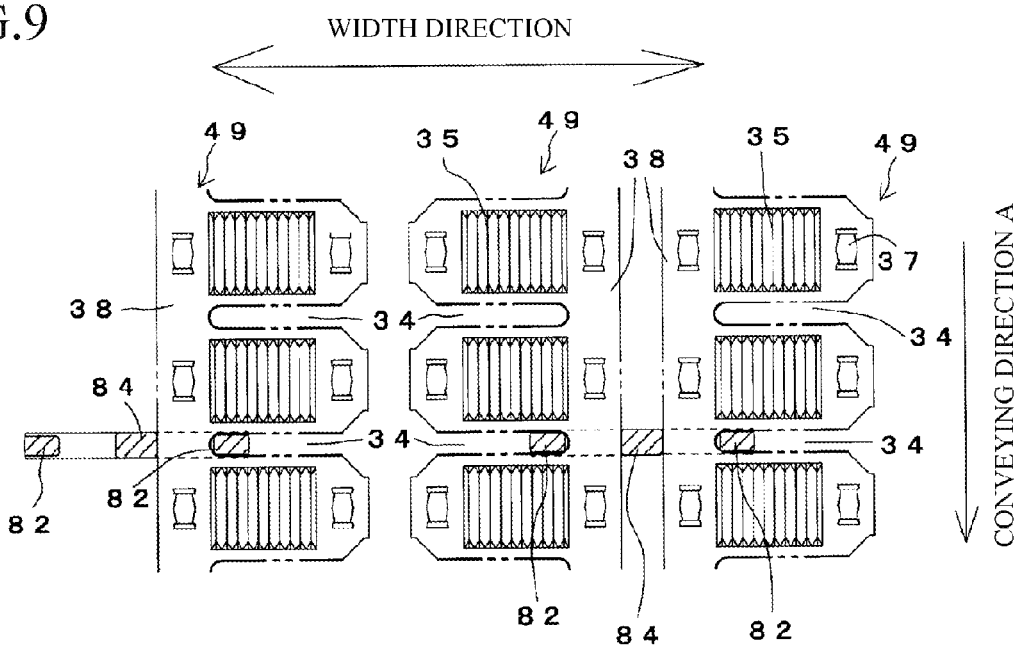
FIG. 9 is a plan view depicting how metal strips are fed in the conveying direction using feed pins that have feed portions and guide portions formed at front ends thereof for a multiple tool setting where the metal strips face each other.
Figure 10:
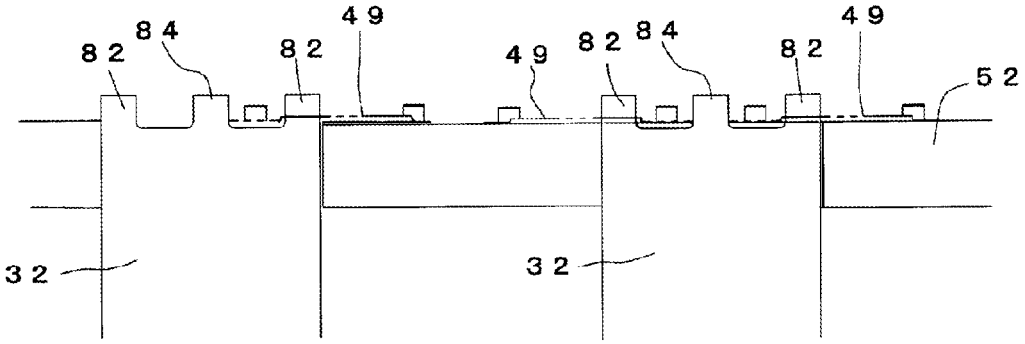
FIG. 10 is a front view depicting the state in FIG. 9 when looking from the front in the feeding direction.

FIGS. 9 and 10 depict another example of a multiple tool setting.

In FIG. 9, in the same way as in FIG. 7, a plurality of metal strips 49 are disposed in the width direction and are conveyed simultaneously, but the openings of the respective cutaway portions 34 are alternately disposed in the width direction. Here, an example case where three metal strips 49 are disposed in the width direction is depicted, with the openings of the metal strip 49 disposed on the left side facing the openings of the metal strip 49 disposed in the center. The joining portion 38 of the metal strip 49 disposed in the center faces the joining portion 38 of the metal strip 49 disposed on the right side.

When the metal strips 49 are disposed facing one another in this way, it is possible to use feed pins 32 that are shared by two metal strips 49.

That is, as depicted in FIG. 10, the front end portions of the feed pins 32 are formed so as to be split into three prongs with the protrusions on both ends in the width direction as the feed portions 82 and the protrusion in the center as the guide portion 84.

Both side surfaces in the width direction of the guide portion 84 contact the respective side surfaces of the joining portions 38 of the metal strips 49 that are positioned on both sides of the guide portion 84 in the width direction. The gap in the width direction between two metal strips 49 whose joining portions 38 face one another needs to be set at a width that enables the guide portion 84 to advance into the gap with both side surfaces in the width direction of the guide portion 84 contacting the joining portion 38-side surfaces of the respective metal strips 49.

Note that since only three metal strips 49 are depicted here, the metal strip 49 on the left uses only the left feed portion 82 and the center guide portion 84 of the feed pin 32 that is formed into three prongs. In this case, it is possible to use a feed pin 32 whose front end portion is two-pronged like that depicted in FIG. 6 for a metal strip 49 that is incapable of using a feed pin shared with another metal strip 49.

In this way, for a multiple tool setting where the metal strips face one another, since the guide portion 84 can be shared by two metal strips 49, it is possible to reduce the number of components and to reduce the gap in the width direction between the respective metal strips 49, which contributes to miniaturization of the entire apparatus.

Note that as described above, a plurality of the feed pins 32 are disposed in the width direction relative to one moving body 55 that extends in the width direction. By providing feed pins 32 corresponding to the respective metal strips 49 on one moving body 55, it is possible to synchronize the up-down movement and the conveying speed of the respective feed pins 32.

Second Embodiment of Guide Portions

Figure 11:
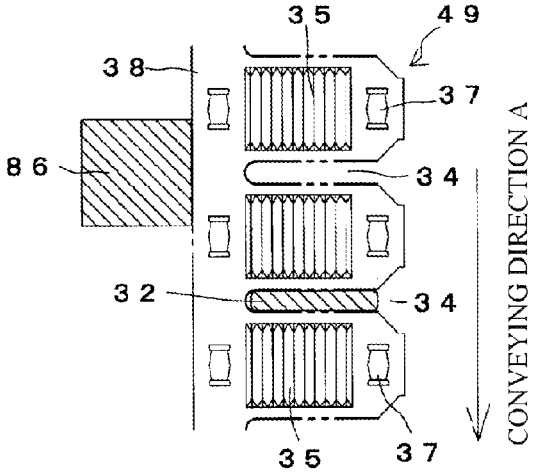
FIG. 11 is a plan view depicting how a metal strip is fed in the conveying direction for a case where guide portions capable of moving together with the feed pins in the conveying direction are provided.
Figure 12:
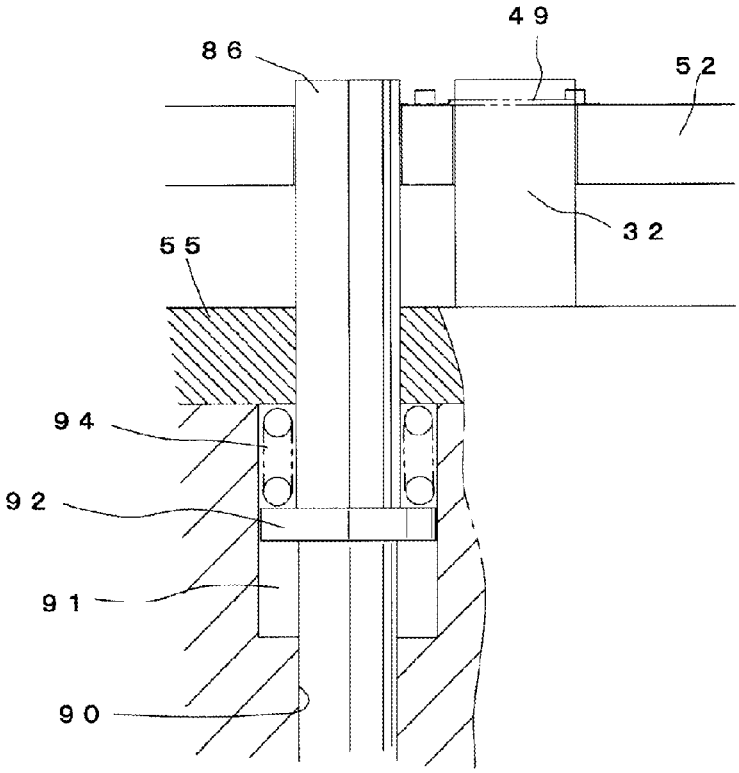
FIG. 12 is a front view depicting the state in FIG. 11 when looking from the front in the feeding direction.

Next, another embodiment of the guide portions will be described with reference to FIGS. 11 and 12.

The guide portions in the present embodiment are guide pins 86 provided on each moving body 55 separately to the feed pins 32. In the same way as the embodiment described above, each guide pin 86 contacts the side surface on the opposite side of a metal strip 49 to the openings of the cutaway portions 34 and guides the conveyance of the metal strip 49. The guide portions 86 in the present embodiment move in the conveying direction A in synchronization with the feed pins 32.

Each guide pin 86 is disposed so as to be capable of moving up and down inside a through-hole 90 formed in a moving body 55. The lower end portion of the guide pin 86 protrudes beyond the lower surface of the moving body 55, an enlarged diameter portion 91 where the diameter is larger than the guide pin 86 is formed at an intermediate part of the through-hole 90 in the moving body 55, and a spring 94 that is an energizing means that energizes the guide pin 86 downward is disposed in such enlarged diameter portion 91. A flange portion 96 formed with substantially the same diameter as the enlarged diameter portion 91 is provided on a part of the guide pin 86 that positionally corresponds to the enlarged diameter portion 91. The spring 94 with the downward energizing force is disposed between the upper surface of the flange portion 96 and the top surface of the enlarged diameter portion 91.

This guide pin 86 is provided on a moving body 55 with the same construction as the feed pin 32, so that when the moving body 55 is not positioned on the plate cam 74, the lower end portion of the feed pin 32 protrudes downward due to the spring 70 and the front end portion of the guide pin 86 is positioned below the metal strip 49. When the moving body 55 has moved onto the plate cam 74, the lower end portion of the guide pin 86 that protrudes beyond the lower surface of the moving body 55 contacts the plate cam 74 so that the guide pin 86 rises and contacts the side surface on the opposite side of the metal strip 49 to the openings of the cutaway portions 34.

Note that in the present embodiment, the positions of the guide pin 86 and the feed pin 32 are not aligned in the width direction and are disposed at positions that are displaced along the conveying direction.

This is because energizing means in the form of the springs 70, 94 that press the feed pin 32 and the guide pin 86 downward are provided inside the moving body 55 and it is difficult to provide sufficient space to align such means in the width direction.

Figure 13:
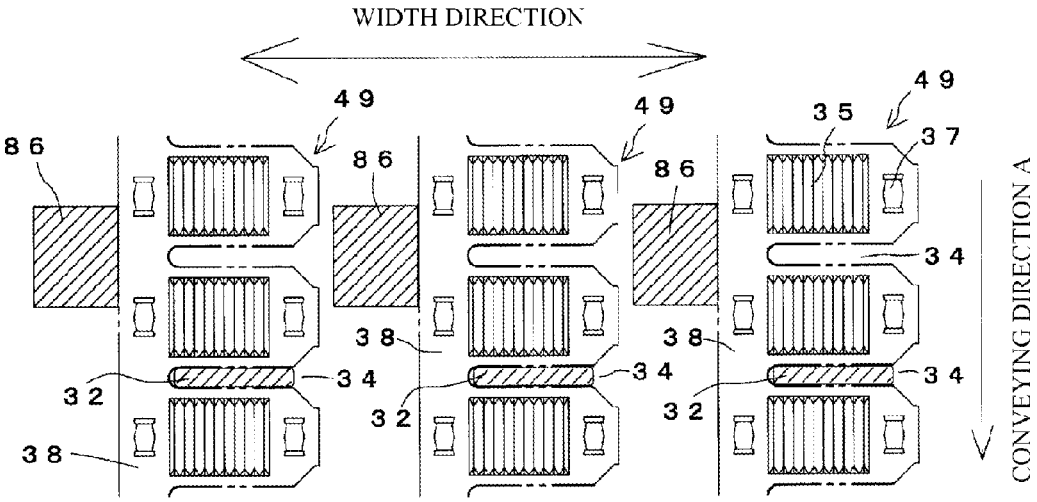
FIG. 13 is a plan view depicting how metal strips are fed in the conveying direction using guide portions capable of moving together with the feed pins in the conveying direction for a multiple tool setting where the metal strips face in the same direction.

FIG. 13 depicts an example (multiple tool setting) where the guide pins 86 are provided separately to the feed pins 32 on the moving bodies 55, a plurality of metal strips 49 are disposed in the width direction, and the plurality of metal strips 49 are conveyed simultaneously.

In the multiple tool setting example in FIG. 13, the plurality of metal strips 49 are in an aligned arrangement where the openings of the cutaway portions 34 all face in the same direction. In this case, it is possible to use a pair of a guide pin 86 and a feed pin 32 for each respective metal strip 49.

That is, since an example is depicted where three metal strips 49 are disposed in the width direction, three pairs of a guide pin 86 and a feed pin 32 are provided.

The plurality of feed pins 32 and guide pins 86 are disposed in the width direction on each moving body 55 that extends in the width direction (not depicted). By providing a feed pin 32 and a guide pin 86 corresponding to each metal strip 49 on each moving body 55, it is possible to synchronize the up-down movement and conveying speed of each feed pin 32 and each guide pin 86.

Figure 14:
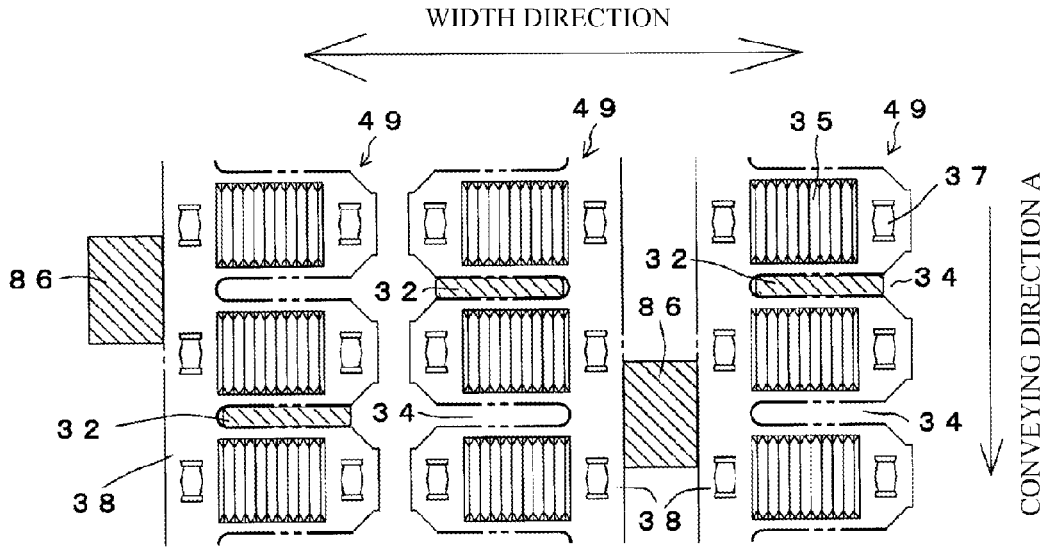
FIG. 14 is a plan view depicting how metal strips are fed in the conveying direction using guide portions capable of moving together with the feed pins in the conveying direction for a multiple tool setting where the metal strips face each other.

FIG. 14 depicts another example of a machine tool setting.

FIG. 14 depicts an example where a plurality of metal strips 49 are disposed in the width direction and the openings of the respective cutaway portions 34 are disposed so as to alternate in the width direction. Here, an example case where three metal strips 49 are disposed in the width direction is depicted, with the openings of the metal strip 49 disposed on the left side facing the openings of the metal strip 49 disposed in the center. The joining portion 38 of the metal strip 49 disposed in the center faces the joining portion 38 of the metal strip 49 disposed on the right side.

When the metal strips 49 are disposed facing one another in this way, it is possible to use guide pins 86 that are shared by two metal strips 49.

Here, two guide pins 86 are provided for three metal strips 49. Out of these, the guide pin 86 positioned on the right is disposed at a position where the respective side surfaces in the width direction contact both the side surface on the joining portion 38 side of the metal strip 49 on the right and the side surface on the joining portion 38 side of the metal strip 49 in the center. That is, the metal strip 49 on the right and the metal strip 49 in the center are guided by a single shared guide pin 86. One guide pin 86 is disposed for the metal strip 49 on the left. Since it is difficult to provide the feed pins 32 and the guide pins 86 so as to be adjacent in the width direction, the feed pins 32 and the guide pins 86 are disposed at positions that are displaced in the conveying direction.

When the metal strips 49 are disposed facing one another in this way, the gap in the width direction between two metal strips 49 whose joining portions 38 face one another needs to be set at a width that enables the guide pin 86 to advance into the gap with both side surfaces in the width direction of the guide pin 86 contacting the joining portion 38-side surfaces of the respective metal strips 49.

In this way, for a multiple tool setting where the metal strips face one another, since the guide pin 86 can be shared by two metal strips 49, it is possible to reduce the number of components and to reduce the gap in the width direction between the respective metal strips 49, which contributes to miniaturization of the entire apparatus.

Note that as described above, the plurality of feed pins 32 and the plurality of guide pins 86 are disposed in the width direction on one moving body 55 that extends in the width direction (not illustrated). By providing a feed pin 32 corresponding to each metal strip 49 on individual moving bodies 55, it is possible to synchronize the up-down movement and conveying speed of the respective feed pins 32.

Third Embodiment of Guide Portions

Figure 15:
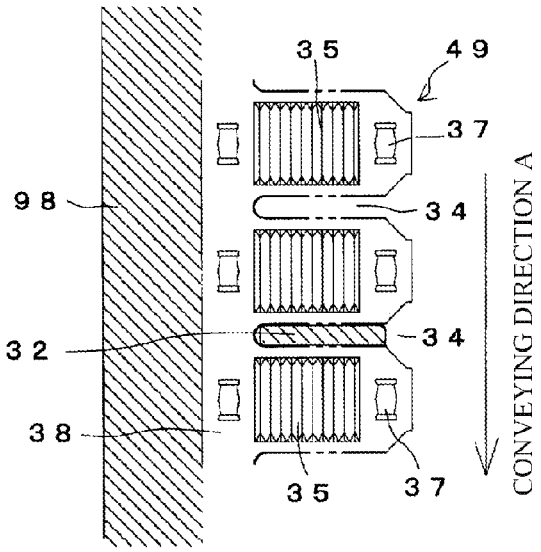
FIG. 15 is a plan view depicting how a metal strip is fed in the conveying direction for a case where a guide portion in the form of a fixed wall is used.
Figure 16:
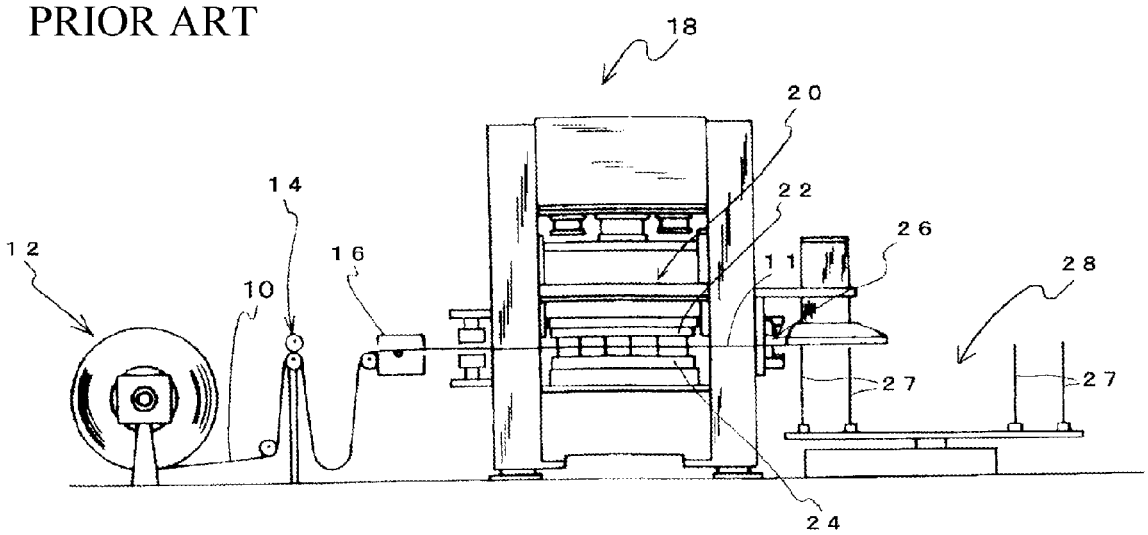
FIG.16 PRIOR ART
FIG. 16 is a diagram useful in explaining the overall construction of a manufacturing apparatus that manufactures heat exchanger fins.
Figure 17:
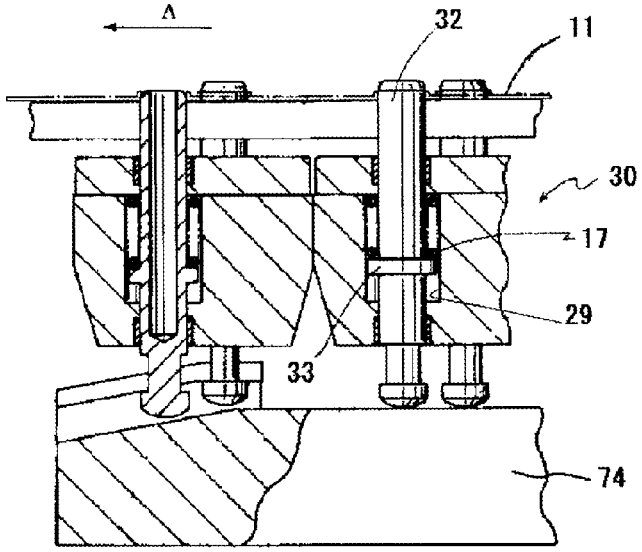
FIG.17 PRIOR ART
FIG. 17 is a diagram useful in explaining an existing feeding apparatus that feeds a metal strip in a conveying direction.

Another embodiment of the guide portions is depicted in FIG. 15.

In this embodiment, a guide portion 98 is a fixed wall portion and is provided so as to constantly contact the side surface of the moving metal strip 49 on the opposite side to the openings in the cutaway portions 34. However, since resistance will be produced between the side surface of the moving metal strip 49 and the guide portion 98 when a fixed wall portion is used as the guide portion 98, guide portions that are capable of moving in the conveying direction as described earlier are considered preferable.

Note that the metal strips conveyed in the conveying direction by the feeding apparatus according to the present invention are not limited to strips of the construction depicted in FIG. 1 and it is also possible to use a different construction with different numbers, positions, shapes, and the like for the louvers 35 and/or the openings 37.

Although the present invention has been described above by way of the preferred embodiments, the present invention is not limited to such embodiments and it should be obvious that various modifications may be implemented without departing from the scope of the invention.

What is claimed is:

1. A feeding apparatus operable when manufacturing a flattened tube fin where cutaway portions, into which flattened tubes used for heat exchanging are inserted, are formed from one side toward another side in a width direction thereof, to feed a metal strip after formation of the cutaway portions in a thin metal plate but before cutting into predetermined lengths, the feeding apparatus comprising:

a reference plate on whose upper surface the metal strip is placed and in which a slit, which extends in a conveying direction of the metal strip, is formed from an upper surface to a lower surface thereof;

moving bodies that are provided below the reference plate and are capable of being moved by driving means parallel to the reference plate and in the conveying direction of the metal strip;

feed pins that are capable of advancing into the cutaway portions of the metal strip, are provided on the moving bodies so as to be capable of moving up and down with respect to the reference plate, and pull the metal strip in the conveying direction in keeping with movement of the moving bodies when the feed pins have advanced into the cutaway portions of the metal strip; and at least one guide portion that contacts a side surface on an opposite side of the metal strip to the openings of the cutaway portions and guides conveyance of the metal strip.

2. The feeding apparatus for a flattened tube fin according to claim 1, wherein the at least one guide portion is provided so as to be capable of moving in the conveying direction together with the moving bodies.

3. The feeding apparatus for a flattened tube fin according to claim 1, wherein front end portions of the feed pins are formed so as to be split into pulling portions that advance into the cutaway portions and pull the metal strip and the at least one guide portion.

4. The feeding apparatus for a flattened tube fin according to claim 2, wherein front end portions of the feed pins are formed so as to be split into pulling portions that advance into the cutaway portions and pull the metal strip and the at least one guide portion.

* * * * *